US006149239A

United States Patent [19]

Markussen et al.

[11] Patent Number: 6,149,239

[45] Date of Patent: Nov. 21, 2000

[54] FOOT SUPPORT FOR CHAIR OR STOOL

[76] Inventors: Brad D. Markussen; Amy D. Markussen, both of 1672 Emerald St., Broomfield, Colo. 80020

[21] Appl. No.: 09/187,725

[22] Filed: Nov. 5, 1998

[51] Int. Cl.[7] ..... A47C 16/00

[52] U.S. Cl. ..... 297/423.4; 297/423.19; 297/423.44; 248/215; 248/123.11

[58] Field of Search ..... 297/188.12, 188.2, 297/423.4, 423.39, 423.44, 423.1, 423.19, 423.25, 463.1, 463.2, 423.21; 248/215, 214, 122.1, 123.11

[56] References Cited

U.S. PATENT DOCUMENTS

| | | | |
|---|---|---|---|
| 148,343 | 3/1874 | Yates et al. | 297/423.4 X |
| 595,450 | 12/1897 | Archer | 297/423.19 |
| 611,327 | 9/1898 | Kelly | 297/423.19 X |
| 2,576,883 | 11/1951 | Koski | 297/423.4 X |
| 3,245,720 | 4/1966 | Wenger | 297/423.1 |
| 3,891,270 | 6/1975 | Crossman et al. | 297/423.1 X |
| 4,348,051 | 9/1982 | Boucher | 297/423 |
| 4,564,238 | 1/1986 | Wolpert, Jr. | 297/430 |
| 4,896,916 | 1/1990 | Marter | 297/423.1 X |
| 5,174,631 | 12/1992 | Schaevitz | 297/423.19 |
| 5,358,263 | 10/1994 | Aldus et al. | 280/42 |
| 5,688,023 | 11/1997 | Blocker, Jr. | 297/188.2 |
| 5,735,571 | 4/1998 | Colondona | 297/35 |

FOREIGN PATENT DOCUMENTS

| | | | |
|---|---|---|---|
| 2421062 | 11/1974 | Germany | 297/423.19 |

OTHER PUBLICATIONS

"Bodybilt Seating" Product & Options Catalog, Navasota, Texas 77868, dated Jan. 1, 1997.

"Dauphin" Price List, Boonton, New Jersey.

*Primary Examiner*—Laurie K. Cranmer

*Attorney, Agent, or Firm*—James R. Young; Christman Bynum & Johnson

[57] ABSTRACT

A foot rest that is attachable to a chair ring, chair base, or seat post allows a chair occupant to position his or her legs and feet in an ergonomically superior position. The foot rest includes a foot rest support for placement of the chair occupant's feet and extensions that position the chair foot rest a distance from the chair ring, chair base, or seat post to which the foot ring is attached. The foot rest may include one or more telescoping extensions that allow the position of the foot rest support relative to the chair ring, chair base, or seat post to be adjusted by the chair occupant to maximize comfort or utility.

33 Claims, 5 Drawing Sheets

FOOT SUPPORT FOR CHAIR OR STOOL

BACKGROUND OF THE INVENTION

1. Field of the Invention

This invention relates generally to a foot rest and extension for a chair or stool and, more particularly, to a removable foot rest and extension for a chair or stool.

2. Description of the Prior Art

A chair is generally designed to accommodate one person and usually consists of a seat resting on three, four, or five legs, a backrest, and sometimes arm rests. The seat of an office chair generally rests on one seat post and is attached to the seat post in such a way that allows the seat to swivel atop the seat post. In addition, an office chair may be designed to allow an occupant to adjust seat height by adjusting seat post length. Generally, four to five legs of an office chair base extend outward from the seat post to provide stability. Office chairs may also include wheels or casters mounted beneath chair leg ends to increase mobility of a chair occupant. A foot ring may be mounted on a seat post or chair legs, providing an occupant with an area on which to rest his/her feet. Generally, a foot ring consists of a tube drawn into a circle with its center located in the area of the seat post and a diameter of eighteen to twenty-four inches, and is removably attached to the seat post with spokes that extend out from the seat post to the ring.

Typically, from the top view of a chair, footrests do not extend beyond the seat of the chair. This characteristic requires a chair occupant to flex, or bend, his or her leg at the knee, decreasing the angle between the femur and tibia/fibula to less than ninety degrees. Maintaining this position can cause muscle fatigue and back strain; stress on legs, back, and neck; poor circulation in legs and feet; improper posture; and uncomfortable seating. Therefore, an ergonomic foot rest for a chair is desirable that does not create these problems for the chair occupant. Preferably, such a foot rest would be easy to attach and remove from the chair and could be used with existing chairs without modification to the chairs.

A foot rest designed with consideration of orthopedic factors is shown in U.S. Pat. No. 5,735,571 issued to Colondona and U.S. Pat. No. 4,764,258 issued to Wolpert. The Colondona patent discloses a foot rest frame and sling combination as a component of a portable foldable reclining chair. However, the foot rest frame of the Colondona patent is pivotally mounted onto a specifically designed chair and is joined to the bottom of the seat of the reclining chair by utilizing independent apparatuses, foot rest locking clamps and foot rest extension bar guides, specifically designed and permanently attached to the reclining chair. In addition, the Colondona patented foot rest positions a chair occupant's thigh and lower leg at a one hundred and eighty degree angle and is designed for optimal orthopedic comfort when an occupant is reclining and relaxing. Thus the Colondona patent is neither ergonomically suitable for a person sitting up, adaptable to a previously existing chair, nor removable.

The Wolpert patent discloses a leg rest for use in connection with a certain type of wheel chair. The leg rest assembly is designed to be retrofitted into an existing wheel chair, requiring modification of the wheel chair. In addition, the leg rest disclosed in the Wolpert patent is designed to hold one leg in a position wherein the thigh-to-lower leg angle is approximately one hundred and eighty degrees. Thus the leg rest of the Wolpert patent is neither ergonomically suitable for both legs of a person nor easy to attach and remove, and it requires modification of a preexisting chair.

Therefore, in spite of the well-developed state of chairs, there remains a need for a foot rest that is easily attachable to and removable from conventional chairs and stools, without requiring modification to the chair or stool, and that provides ergonomic support for the feet and legs of the chair occupant.

SUMMARY OF THE INVENTION

It is a general object of this invention to provide an ergonomically designed foot rest or extension that reduces or eliminates medical conditions associated with repetitive or continuous flexing or bending of the knees.

Another general object of this invention is to provide a foot rest or extension that is removably attachable to a chair or stool.

It is still another general object of this invention to provide a foot rest or extension that is easily attached to and removed from a seat post, foot rest ring, or legs of a chair or stool without need for modification of the chair or stool.

It is yet another general object of this invention to provide a foot rest or extension that can be used by people having legs and feet of various sizes.

It is a further general object of this invention to provide a foot rest or extension that is durable, simple in structure, and inexpensive to manufacture.

Additional objects, advantages, and novel features of the invention shall be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

To achieve the foregoing and other objects and in accordance with the purposes of the present invention, as embodied and broadly described herein, an attachment to a chair ring having spokes includes a bar having angled extensions that rest on the chair ring and hooked ends that are coupled to the spokes of the chair ring.

In another embodiment of an apparatus implemented in accordance with the purposes of the present invention, an attachment to a chair ring having spokes or a chair base having legs includes first and second extensions, each of said first and second extensions having a first end and a second end; a foot rest support connected to said first end of said first extension and said first end of said second extension; a third extension connected to said second end of said first extension such that an angle exists between said first extension and said third extension; a fourth extension connected to said second end of said second extension such that said angle exists between said second extension and said fourth extension; a first hook attached to said third extension; and a second hook attached to said fourth extension.

In another embodiment of an apparatus implemented in accordance with the purposes of the present invention, an attachment to a chair includes a chair ring having a perimeter section; at least one support extending outward from said perimeter section at an angle; and a foot rest connected to said support.

In another embodiment of an apparatus implemented in accordance with the purposes of the present invention, an attachment to a chair base having legs includes a bar having extensions that rest on at least two legs of the chair base and a portion that extends under a third leg of the chair base.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings

DETAILED DESCRIPTION OF THE PREFERRED EMBODIMENTS

Figure 1:
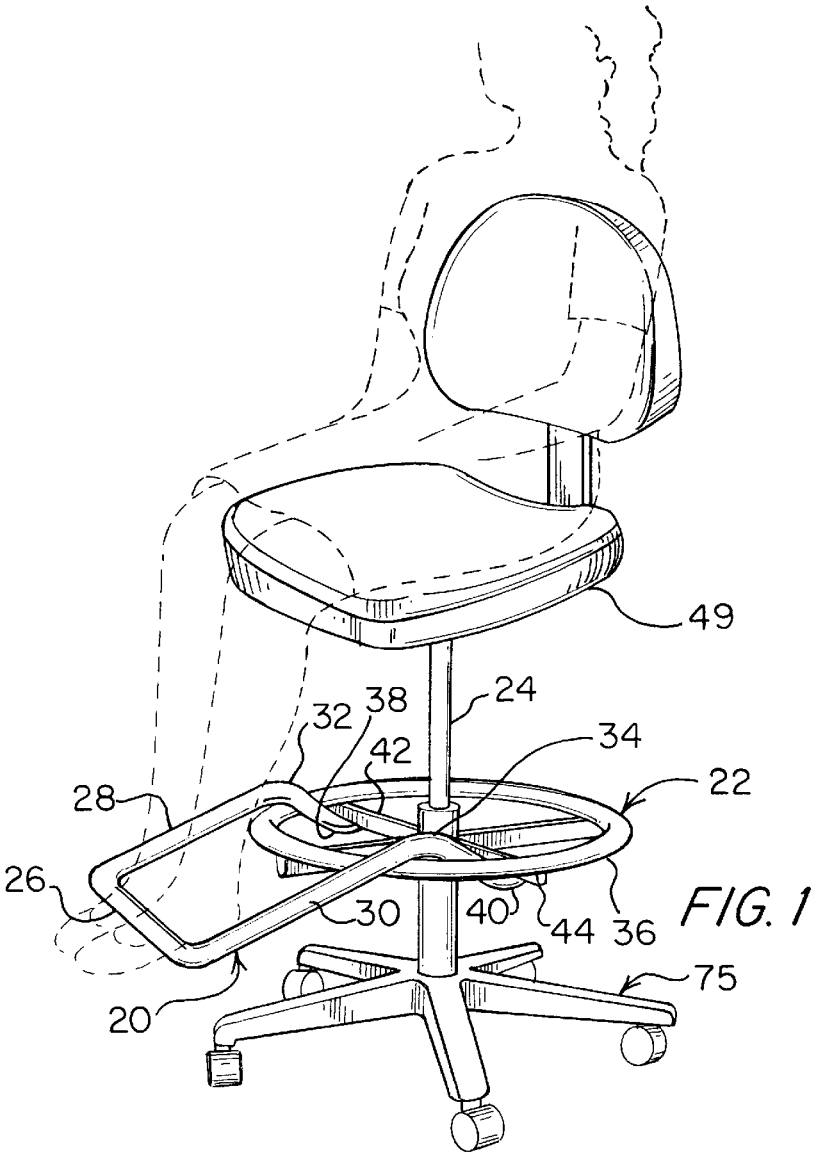
FIG. 1 is a perspective view of a first embodiment of a foot rest designed in accordance with the principles of the present invention, wherein the foot rest is attached to a foot ring of a conventional chair.
Figure 2:
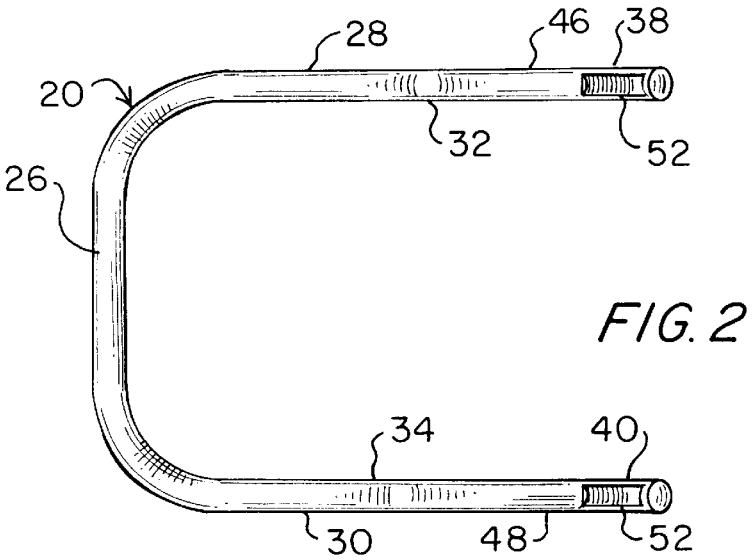
FIG. 2 is a bottom plan view of the foot rest of FIG. 1.

The foot rest or extension 20 of the present invention, as illustrated in FIGS. 1, is attached to a foot or chair ring 22 on a chair or seat post 24 and includes a foot support or bar 26 for holding and supporting the chair occupant's feet, extensions 28, 30 for projecting the foot rest support 26 outward from the foot ring 22, angled potions 32, 34 for connecting the foot rest 20 to, or supporting the foot rest 20 on, the circular or curved portion or perimeter section 36 of the foot ring 22, and hooked ends 38, 40 for connecting or attaching the foot rest 20 to the spokes 42, 44, respectively, of the foot ring 22 so that the foot rest 20 does not easily become dislodged from the chair ring 22. Preferably, the foot rest 20 also includes suitable means, such as a wire clip or lock to secure the hook ends 38, 40 to the spokes 42, 44, respectively. The foot rest 20 may comprise a frame fabricated with a single piece of material, as best illustrated in FIGS. 1 and 2, or may include a frame comprising several interconnected pieces of the same or different materials. The frame is preferably, but not necessarily, substantially U-shaped, such as those shown in FIGS. 1, 2, 5, 10, and 12, comprising the elongated foot rest support 26 and the pair of elongated extensions 28,30. Each of these components will be discussed in more detail below.

A significant advantage of the removable foot rest 20 is that it can be attached to a chair equipped with a foot ring to provide a chair occupant with an ergonomically positioned foot rest for the chair occupant. Chairs with foot rings generally have seats sufficiently high off of the ground or floor so that, without the foot ring, a chair occupant would not have a reachable surface on which surface to rest his or her feet comfortably. Therefore, the chair occupant is relegated to using the foot ring as a foot rest.

When the chair occupant uses a foot ring to support his or her feet, the chair occupant's knees become flexed, or bent, so that the angle between the femur and fibula/tibia in the chair occupant's legs is less than ninety degrees. This leg positioning is ergonomically unfavorable for a chair occupant as it can result in muscle fatigue and back strain; stress on legs, back, and neck; poor circulation in legs and feet; improper posture; and uncomfortable seating. To avoid these results, the angle between lower legs and thighs should be ninety degrees or slightly greater. The removable foot rest 20 of the present invention, when attached to the foot ring 22, enables a chair occupant to place his/her feet in a position that results in ergonomically superior leg positioning and reduces the problems associated with supporting feet directly on the foot ring 22.

A second significant advantage of the foot rest 20 is that it is simple in design, resulting in relatively inexpensive manufacturing and easy installation. The removable foot rest 20 can easily be installed on, and removed from, the foot ring 22. No hand tools and relatively little skill are necessary for installation.

A third significant advantage of the foot rest 20 is that it requires little or no modification of a chair or foot ring. No apparatus needs to be attached to a chair or a foot ring prior to installation of the removable foot rest 20. Since the foot rest 20 itself is readily removable, little effort is needed to return a chair to its original condition should the foot rest 20 no longer be desired or needed.

Figure 3:
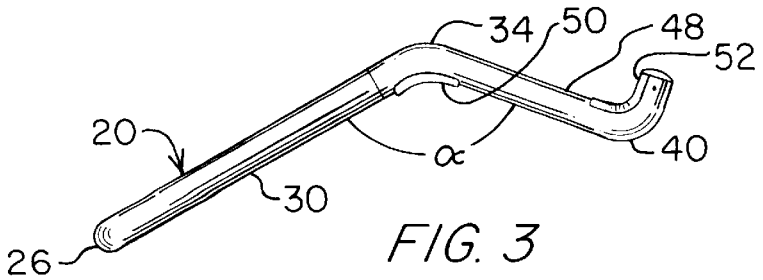
FIG. 3 is an elevation view of the foot rest of FIG. 1.
Figure 4:
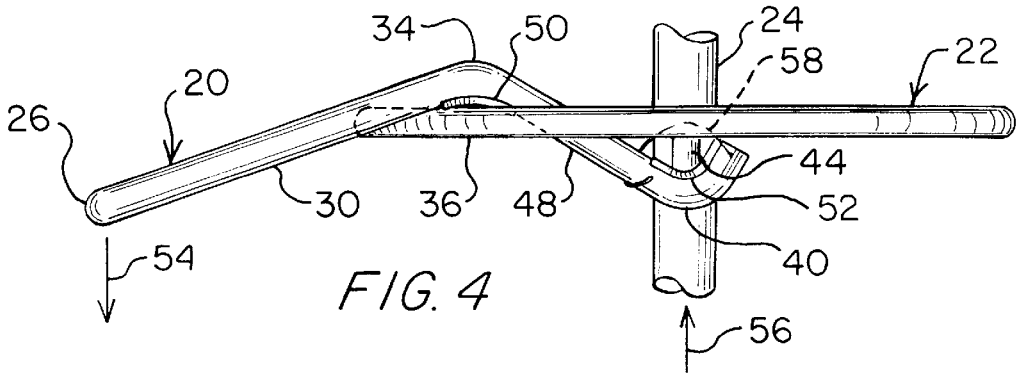
FIG. 4 is an elevation view of the foot rest and foot ring of FIG. 1.

Referring now to FIGS. 2–4, the foot support 20 includes angled or concave portions 32, 34 such that the foot rest 20 is supported on the chair ring 22 by having the angled portions 32, 34 of the foot rest 20 rest against the chair ring 22. The angled portion 32 separates the extension 28 from the extension 46 and creates an angle $\alpha$ between the extensions 28, 46. Likewise, the angled portion 34 separates the extension 30 from the extension 48 and creates the angle $\alpha$ between the extensions 30, 48. The angle $\alpha$ can vary, but is preferably chosen such that, when a chair occupant is using the foot rest 20, the angle between the chair occupant's lower legs and thighs is ninety degrees or greater. Therefore, the angle $\alpha$ is preferably between 90 and 135 degrees and is optimally between 100 and 120 degrees.

The lengths of the extensions 28, 30 can vary, depending on the desired relationship or distance between the curved portion 36 of the foot ring 22 and the foot rest support 26, the desired relationship or distance between the foot ring 22 and the seat 49, and the lengths of a chair occupant's legs. Preferably, the extensions 28, 30 are short enough so that the foot rest support 26 does not contact the ground or floor and so that the foot rest 20 does not cause the chair to tilt, fall over, or become unstable.

The hooked ends 38, 40 help to anchor or securely attach the foot rest 20 to the chair ring 22 and reduce the chance of the foot rest disengaging from the chair ring 22. In addition, the hooked ends 38, 40 also help prevent the foot rest 20 from sliding forward or away from the chair ring 22 when a chair occupant places his or her feet on the foot rest support 26. The hooked ends 38, 40, as illustrated in FIGS. 3 and 4, have approximately a ninety degree bend or angle. While other angles may be used in the hook ends 38, 40, the hook ends 38, 40 preferably have create sufficient contact between the foot rest 20 and the spokes 42, 44 of the chair ring 22 to prevent the foot rest 20 from disengaging or separating from the chair ring 22.

Optional padding 50 may be added to the foot rest 20 at the concave portions 32,34 to reduce sound or chatter created by interaction or contact between the foot rest 20 and the chair ring 26 and to reduce damage to the foot ring 22 or the foot rest 20 generated from contact between the two when a chair occupant places his/her feet on the foot rest support 26. Similarly, optional padding 52 may be added to the foot rest 20 at the concave portions of the hooked ends 38, 40. The padding 50, 52 may include a rubberized sponge material or a less forgiving rubber ribbed material. Preferably, the padding 50, 52 assists in holding the foot rest 20 in place on the chair ring 22 and the spokes 42, 44 by increasing friction between the foot rest 20 and the chair ring 22.

The foot rest apparatus 20 is preferably fabricated of a metallic material providing durability and stiffness. However, the foot rest apparatus 20 may be made of a plastic, wooden, or other material that exhibits similar properties. Selection of material for the foot rest 20 may be based on aesthetic reasons (i. e., to match the material of the foot rest 20 to the material of which the chair ring 22 is made).

While the foot rest 20 preferably has a circular cross-section, the foot rest 20 may have a oval, square, rectangular or other cross-sectional shape. In addition, different parts of the foot rest 20 may have different cross-sections. For example, the foot rest support 26 may have a rectangular cross-section to increase the surface area upon which the chair occupant can rest his or her feet while the remainder of the foot rest has a circular cross-section.

Figure 5:
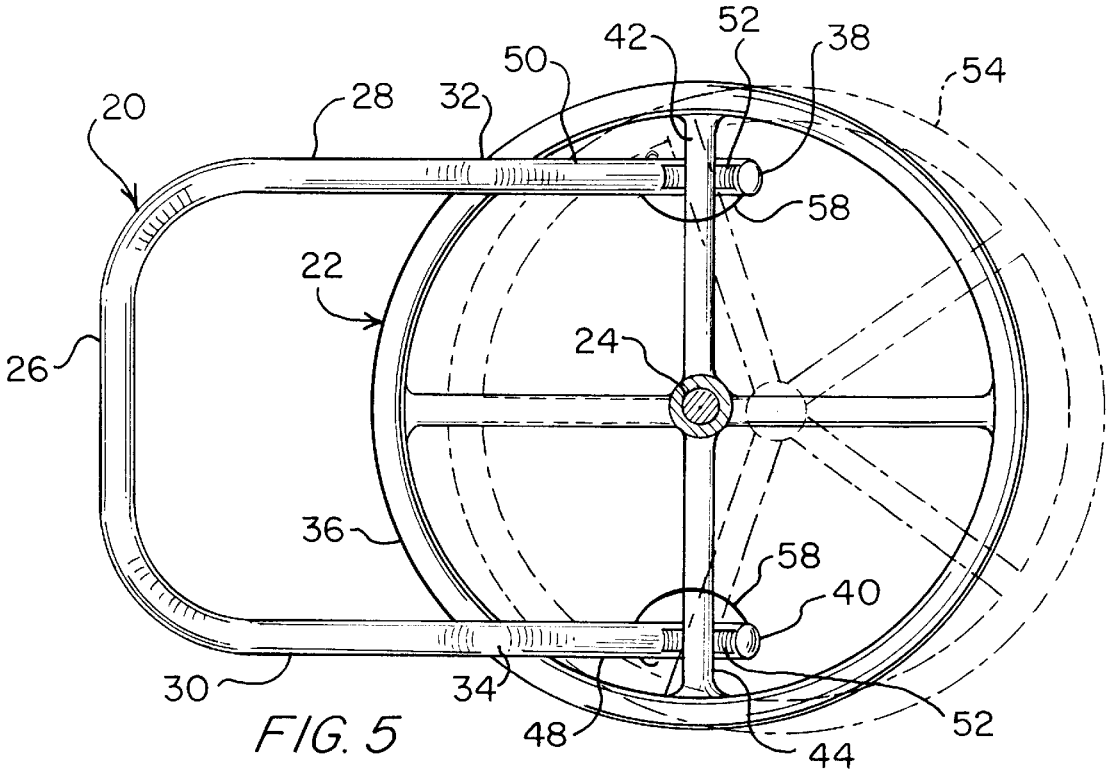
FIG. 5 is a bottom plan view of the foot rest and foot ring of FIG. 1.

The foot rest 20 can work with chair rings having different numbers of spokes, as best illustrated in FIG. 5. The chair 22 illustrated in FIGS. 1 and 5 has four spokes, including the spokes 42, 44 to which the hook ends 38, 40 of the foot rest 20 are attached. However, the foot rest 20 can also be attached to a five spoke chair ring 54 (shown in phantom lines in FIG. 5) in a manner similar to how the foot rest 20 attaches to the four spoke chair ring 22.

The number of spokes within a foot or chair ring to which the foot rest 20 is attached may affect the location on the circular portion of the chair ring 22 where the foot rest 20 comes in contact with the chair ring 22, thus possibly affecting the angle $\alpha$ and the lengths of the extensions 48, 50 necessary to allow the hooked ends 38, 40 to provide stable attachment of the foot rest 20 to the chair ring 22. Foot rests designed in accordance with the present invention can be made for use with chair rings 22 having two, three, four, five, six, or even more spokes.

During use of the foot rest 20, a chair occupant places the removable foot rest 20 on the foot ring 22 with the hooked ends 38, 40 placed under two of the spokes the 42, 44, respectively, of the foot ring 22 so that the concave angled portions 32, 34 are resting on and supported by the circular or curved portion 36 of the foot ring 22. The chair occupant can then place his or her feet on the foot rest support 26 while occupying the chair.

When the chair occupant places his or her feet on the foot rest support 26, the weight of the feet on the foot rest support 26 will tend to push or force the foot rest support 26 towards the floor or ground (not shown) supporting the chair, as indicated by the arrow 54 in FIG. 4. During this time, the foot rest 26 acts as a lever, with its fulcrum at the angled portions 32, 34 being supported by the curved portion or perimeter section 36 of the chair ring 22. Therefore, when the foot rest support 26 is being held or forced in the direction indicated by the arrow 54, the hooked ends 38, 40 of the foot rest 20 will be forced in the opposite direction, as indicated by the arrow 56 in FIG. 4, thereby increasing the contact presure between the hooked ends 38,40 and the spokes 42, 44, respectively, of the chair ring 22 and reducing the likelihood that the foot rest 20 will move or become unattached from the chair ring 22 during use by the chair occupant. Preferably, the extensions 28, 30 are long or heavy enough, or the foot rest support is heavy enough, such that, even when no external force or pressure is placed (such as from the chair occupant's feet) on the foot rest support 26 to direct or force the foot rest support 26 in the direction indicated by the arrow 54, the hooked ends 38, 40 are still forced or pressed against the spokes 42, 44, respectively, of the chair ring 22 in the direction indicated by the arrow 56 and so that the foot rest 20 does not rock on the curved portion 36 of the chair ring 22 or otherwise be unstably positioned on the chair ring 22.

The chair occupant can attach or connect the foot rest 20 to the foot ring 22 before or after sitting down. Likewise, the chair occupant can remove or disengage the foot rest 20 from the foot ring 22 before or after getting out of the chair. Preferably, the chair occupant does not step on the foot rest 20 while getting in or out of the chair so that the chair is not inadvertently tipped over.

Typically, the foot ring 22 can be adjusted vertically on the seat post 24 so that the chair occupant can adjust the vertical position of the foot ring 22 on the seat post 24. As a result of such adjustment, the chair occupant can adjust the angle between the chair occupant's lower legs and thighs are ninety degrees or greater or, preferably, at the position that maximizes the chair occupant's comfort.

The foot rest 20 may include optional hooks or wires 58, as best illustrated in FIGS. 4 and 5, that are attached at one end to the hooked ends 38, 40 and wrap around the spokes 42, 44 to more securely attach the foot rest 20 to the chair ring 22. Other suitable attachment devices may also be used to more securely attach the foot rest 20 to the chair ring 22.

Figure 6:
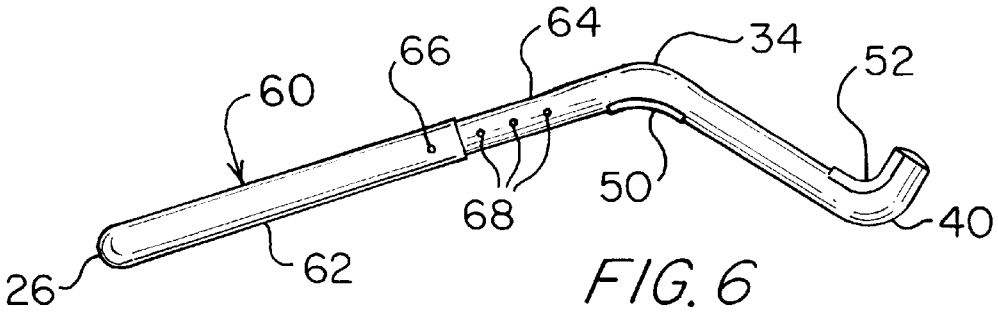
FIG. 6 is an elevation view of a second embodiment of a foot rest designed in accordance with the principles of the present invention.

A second embodiment of a foot rest designed in accordance with the present invention is illustrated in FIG. 6. In this second embodiment, a foot rest 60 includes foot rest support 26, angled portions 32, 34, hooked ends 38, 40, and extensions 46, 48 just as in the foot rest 20 of the first embodiment. However, the foot rest 60 uses a two piece extension between the foot rest support 26 and the angled portion 34 to allow telescoping of the foot rest support 26 away from the angled portion 34, as best illustrated in FIG. 6. Similarly, the foot rest 60 includes a telescoping feature between the foot rest support 26 and the angled portion 32 (hidden from view in FIG. 6 by angled portion 34). The foot rest 60 includes three pieces (only two of which are visible in FIG. 6), the u-shaped foot end portion 62, which contains the foot rest support 26, the angled spoke end portion 64, which includes the angled portion 34 and the hooked end 40, and an angled spoke end portion hidden from view in FIG. 6 by angled spoke and portion 64, similar to the spoke end portion 64, which includes the angled portion 32 and the hooked end 38. The foot end portion 62 includes at least one hole 66, which can be aligned with one of the holes 68 on the spoke end portion 64, to allow the distance between the angled portion 34 and the foot rest support 26 to be adjusted.

Once the hole 62 is aligned with one of the holes 68, a cotter pin, bolt, or other device can be inserted into the holes 62, 68 to secure the foot end portion 62 to the spoke end portion 64.

The telescoping feature of the foot rest extension 60 allows the foot rest extension 60 to be used with a variety of chair occupants and improves the versatility of the chair rest 20 of the first embodiment. Such a telescoping feature can also be incorporated between the angled portion 34 and the hooked end 40 and between the angled portion 32 and the hooked end 42 to allow the foot rests 20, 60 to be used with a variety of chair types.

Figure 7:
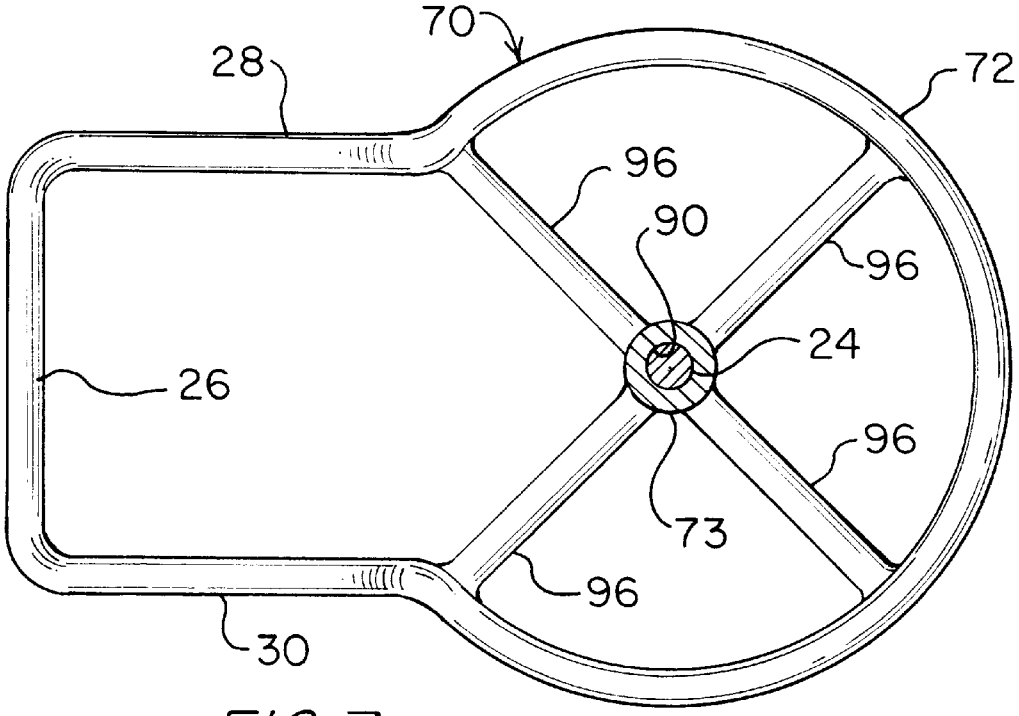
FIG. 7 is a top plan view of a third embodiment of a foot rest designed in accordance with the principles of the present invention.
Figure 8:
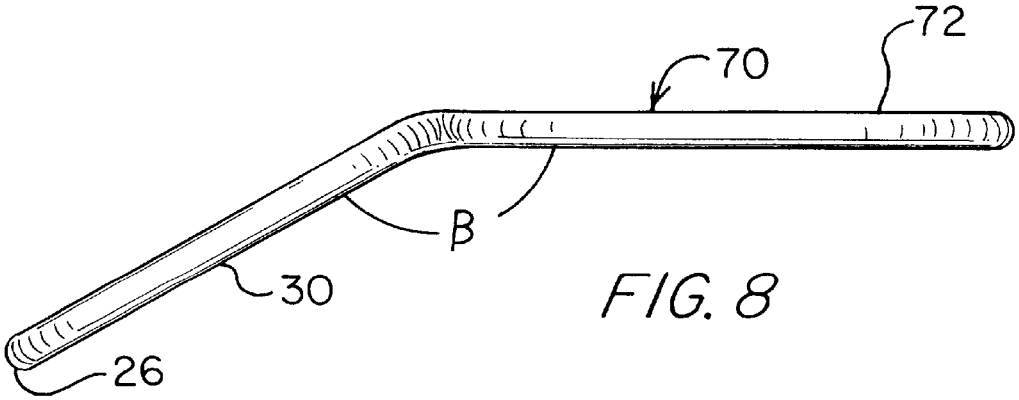
FIG. 8 is an elevation view of the foot rest of FIG. 7.

A third embodiment of a foot rest designed in accordance with the principles of the present invention is illustrated in FIGS. 7 and 8. In this third embodiment, the foot rest 70 includes a foot rest support 26 and extensions 28, 30 attached directly to a chair ring 72 that is attachable to the seat or chair post 24. The chair ring 72 includes a hub 73 that attaches to the seat post 24 and, preferably, fits snugly around the seat post 24. The hub 73 may form a complete circle or closed shape such that the seat 49 or chair base 75 must be removed from the seat post 24 before the hub 73 can be attached to the seat post 24. Alternatively, the hub 73 may include a gap (not shown) between two of the spokes 96 such that the hub 73 can be slipped around the seat post 24, thereby not requiring removal of the seat 49 or chair base 75.

The hub 73 can be attached to the seat post 24 in a variety of ways. For example, one or more screws (not shown) can extend through the hub 73 and into the seat post 24. Alternatively, the hub 73 can include a clamp (not shown) that is tightened around the hub 73, thereby tightening the hub 73 about the seat post 24.

Figure 9:
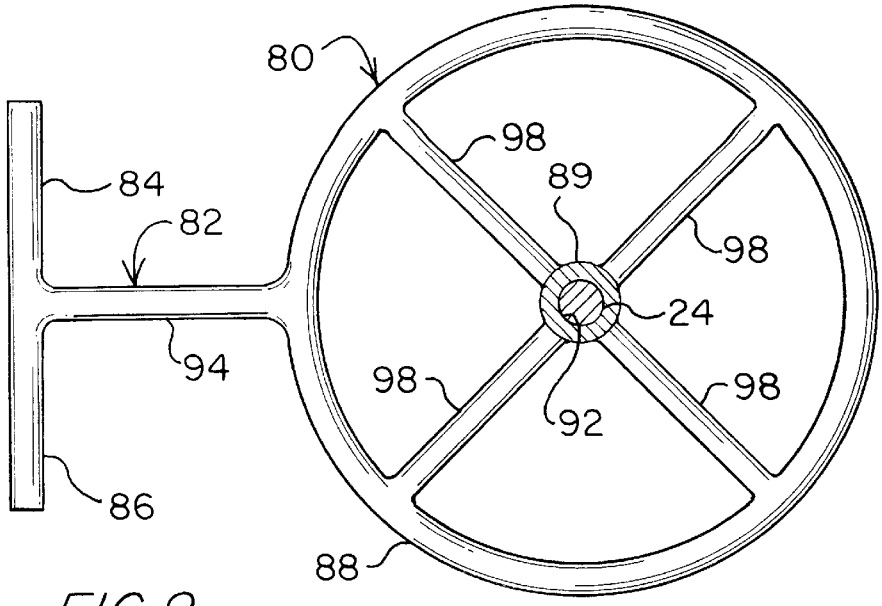
FIG. 9 is a top plan view of a fourth embodiment of a foot rest designed in accordance with the principles of the present invention.

Similar to the third embodiment is a fourth embodiment of a foot rest designed in accordance with the principles of the present invention, as best illustrated in FIG. 9. In the fourth embodiment, the foot rest 80 includes a t-shaped foot extension 82 having foot rest supports 84, 86. The foot rest extension 82 is attached directly to a chair ring 88, preferably the perimeter section of the chair ring 88. If desired, the t-shaped extension 82 can be welded to an existing chair ring to modify the existing chair ring to provide ergonomic benefits to a occupant using such a modified chair ring. The chair ring 88 includes a hub 89 that is similar to the hub 73 of the chair ring 72.

The foot rests 70 and 80 are designed to be attached to a chair not equipped with the foot ring or to replace a foot ring on a chair in order to provide a chair occupant with the ergonomically positioned foot support. The foot rests 70 of the third embodiment in FIGS. 7 and 8 and 80 of the fourth embodiment in FIG. 9 of the present invention possess most of the same advantages as the foot rest apparatus 20 of the first embodiment, with the exception that the foot rests 70, 80 are not as easily attached to, and removed from, a chair.

Preferably, the foot rings 72, 88 can be adjusted vertically on a seat post, such as the seat post 24, to allow adjustment of the vertical distance between the seat 49 and the foot rest supports 26, 84, 86. Therefore, the foot rests 70, 80 may be adjusted for chair occupants with varying lower leg lengths or varying desired position of the foot rest supports 26, 84, 86. The shapes and diameters of the bores 90, 92 in the chair rings 72, 88, respectively, may be designed to allow the foot rests 70, 80 to be installed on the seat posts 24 having cross sections of various diameters or shapes.

The extensions 28, 30 for the foot rest 70, and the length of the extension or support 94 for the foot rest 80 may be straight, bent, or curved for support or aesthetic purposes and may be adjustable or extendable in length (e.g., telescoping) to increase the versatility of the foot rests 70, 80. Preferably, the angle β (see FIG. 8) between the extensions 28, 30 and the chair ring 72 for the foot rest 70 is between 135 and 180 degrees, and optimally, is 145 degrees. The foot extension 80 of FIG. 9 also preferably has an angle between the extension 94 and the foot ring 88.

The components of the foot rest 70 of FIGS. 7 and 8, including the foot ring 72, the foot ring extensions 28, 30, and the foot rest support 26, are comprised of a tubular or solid material with either a round, oval, or polygonal cross-section, with a side or diameter of approximately one to three inches. The spokes 96 are preferably made of a similar material, but likely have a smaller cross-sectional diameter than the foot ring 72, the foot ring extensions 28, 30, or the foot rest support 26. Similarly, the components of the foot rest 80 FIG. 9, including the foot ring 88, the support or extension 94, and the foot rest supports 84, 86, are comprised of a tubular or solid material with either a round, oval, or polygonal cross-section, with a side or diameter of approximately one to three inches. The spokes 96 are preferably made of a similar material, but likely have a smaller cross-sectional diameter than the foot ring 88, the extension 94, or the foot rest supports 84, 86.

While the foot rests 70, 80 are preferably fabricated of a metallic material providing sufficient durability and stiffness, the foot rests 70, 80 also may be composed of plastic, wooden, or other material that exhibits similar properties.

Figure 10:
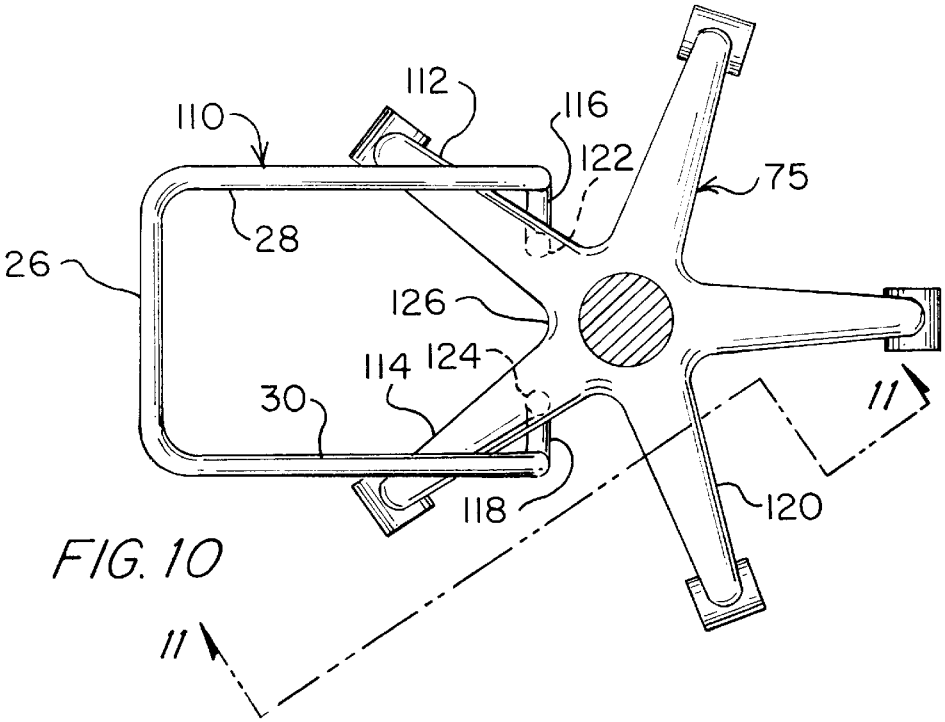
FIG. 10 is a top plan view of a fifth embodiment of a foot rest designed in accordance with the principles of the present invention, wherein the foot rest is shown attached the legs of a chair.
Figure 11:
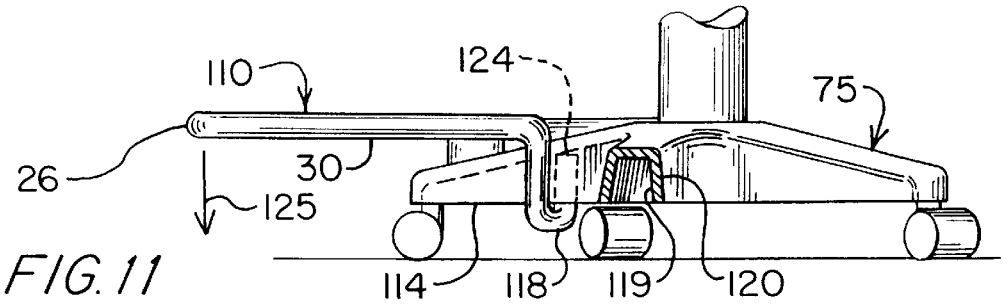
FIG. 11 is an elevation view of the foot rest of FIG. 10, taken along the line 11—11 of FIG. 10.

A fifth embodiment of a foot rest 110 designed in accordance with the principles of the present invention is illustrated in FIGS. 10 and 11. In this fifth embodiment, the foot rest 110, is connected to and hooks around legs 112, 114 of a chair base 75. The foot rest 110 includes foot rest support 26 and extensions 28, 30. The extensions 28, 30 contact, and are supported by, the chair legs 112, 114. The extensions 28, 30 terminate in hooked ends 116, 118, respectively. The hooked ends 116, 118 are curved or bent such that they can hook into the hollow underside portions or cavities of the chair legs 112, 114, respectively. Such a hollow portion 119 of chair leg 120 is illustrated in FIG. 11. Having the ends 122, 124 of the hooked ends 116, 118, respectively, hook into the hollow portions of the chair legs 112, 114, respectively, or hook completely around the chair legs 112, 114, respectively, reduces movement of the foot rest 110 and reduces the chance of disengagement of the foot rest 110 from the chair base 75.

During use of the foot rest 110 by a chair occupant, the chair occupant's feet are placed on the foot rest support 26, thereby pressing or forcing the foot rest support 26 in the direction indicated by the arrow 125 illustrated in FIG. 11. When such force is placed on the foot rest support 26 in the direction indicated by the arrow 125, the hooked ends 116, 118 are forced in a direction opposite to the direction indicated by the arrow 125 and become more securely connected to the chair legs 112, 114, respectively. Therefore, when a chair occupant's feet are placed in the foot rest support 26 of the foot rest 110, the foot rest 110 may become more securely attached to the chair base 75 than when the chair occupant's feet are not placed in the foot rest support 26.

As an alternative to the fifth embodiment 110 of a foot rest, the hooked ends 116, 118 of the foot rest 110 may extend toward each other such that they extend toward or to the area 126 between the chair legs 112, 114 and so that they hook around the chair legs 112, 114 in a manner similar to how the hooked ends 38, 40 of the foot rest 20 hook around spokes 42, 44 of the foot ring 22, as best illustrated in FIGS. 4 and 5. As a further alternative to the fifth embodiment 110 of a foot rest, the hooked ends 116, 118 may be connected such that the foot rest 110 has a continuous shape, which can be square or rectangular.

Figure 12:
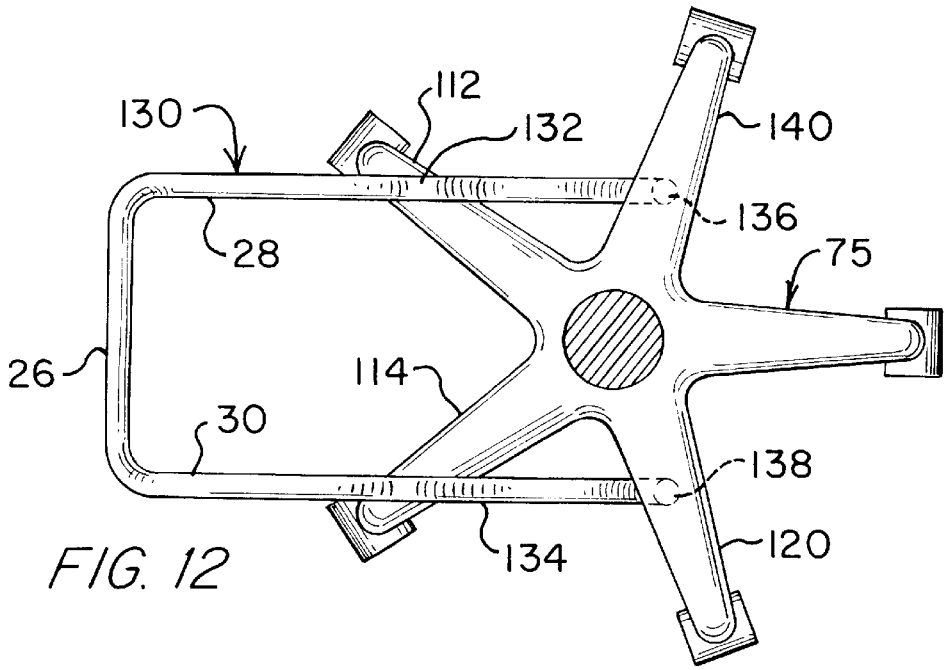
FIG. 12 is a top plan view of a sixth embodiment of a foot rest designed in accordance with the principles of the present invention, wherein the foot rest is shown attached the legs of a chair.
Figure 13:
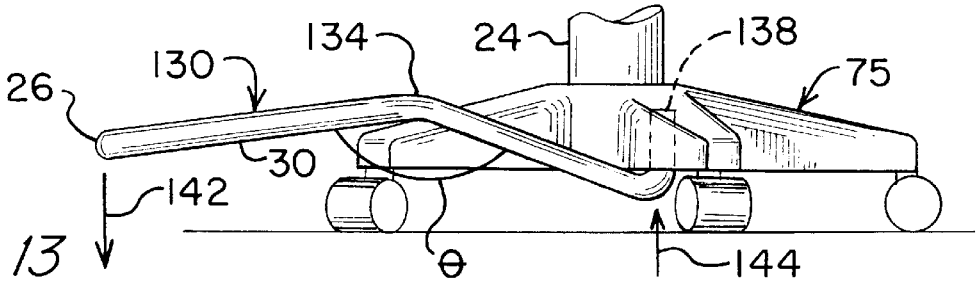
FIG. 13 is is an elevation view of the foot rest of FIG. 12.

A sixth embodiment of a foot rest designed in accordance with the principles of the present invention is illustrated in FIGS. 12 and 13. In this sixth embodiment, the foot rest 130, which is similar to the foot rest 20, includes foot rest support 26 and extensions 28, 30. The extensions 28, 30 contact and are supported by chair legs 112, 114 at the angled portions 132, 134, respectively. The angled portions 132, 134 form an angle θ which will vary depending on the shape and configuration of the chair base 75, but which will generally be between 120 and 180 degrees.

Hooked ends 136, 138 allow the footrest 130 to hook into the hollow portions of chair legs 140, 120, respectively, thereby reducing movement of the foot rest 130 when it is attached to the chair base 75 and reducing the chance of accidental or inadvertent disengagement of the foot rest 130 from the chair base 75. Alternatively, the hooked ends 136, 138 can extend around the chair legs 140, 120, respectively, in a manner similar to how the hooked ends 38, 40 of the foot rest 20 extend around and are secured to the spokes 42, 44, respectively, of the chair ring 22.

During use of the foot rest 130 by a chair occupant, the chair occupant's feet are placed on the foot rest support 26, thereby pressing or forcing the foot rest support in the direction indicated by the arrow 142 illustrated in FIG. 13. When such force is placed on the foot rest support 26 in the direction indicated by the arrow 142, the hooked ends 136,138 are forced in a direction indicated by the arrow 144 and become more securely connected to the chair legs 140, 120, respectively. Therefore, when a chair occupant's feet are placed in the foot rest support 26 of the foot rest 130, the foot rest 130 may become more securely attached to the chair base 75 than when the chair occupant's feet are not placed in the foot rest support 26.

Figure 14:
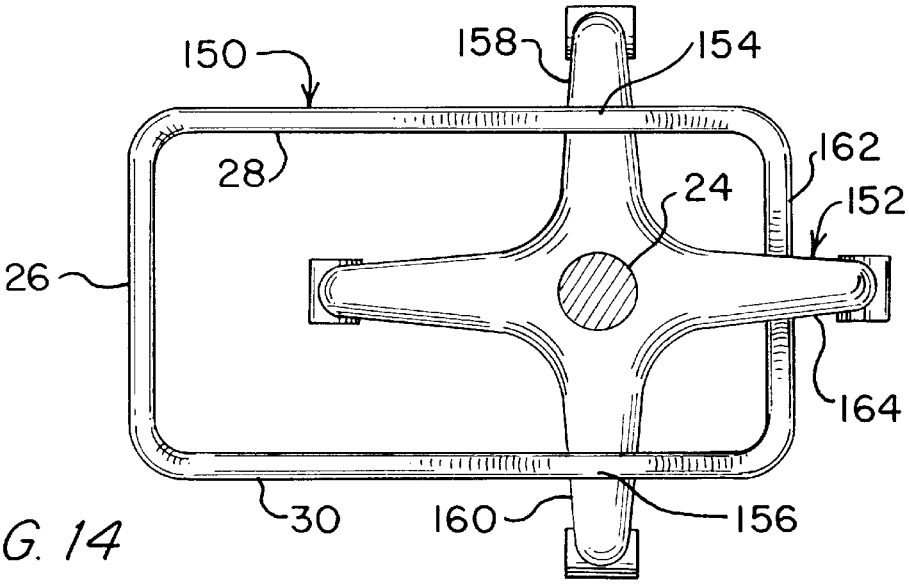
FIG. 14 is top plan view of a seventh embodiment of a foot rest designed in accordance with the principles of the present invention, wherein the foot rest is shown attached to the legs of a chair.

A seventh embodiment of a foot rest designed in accordance with the principles of the present invention is illustrated in FIG. 14. In this seventh embodiment, the foot rest 150, which is similar to the foot rest 130, is attached to a four leg chair base 152. The foot rest 150 includes foot rest support 26, extensions 28, 30, and angled portions 154, 156. The angled portions 154, 156 are similar to the angled portions 32, 34 of the foot rest 20 and the angled portions 132, 134 of the foot rest 130 and are the areas of the foot rest 150 that contact and are supported by legs 158, 160, respectively, of the chair base 152. A portion 162 of the foot rest 150 extends below a chair leg 162 to anchor the foot rest 150 to the chair base 152 and to reduce the chance of disengagement or movement of the foot rest 150. The portion 162 of the foot rest 150 may be v-shaped, with the vertex of the v-shape positioned beneath the chair leg 152, or the portion 162 of the foot rest 150 may be straight or curved. The portions 154, 156 may also angle inward from the foot rest support 26 towards the chair post 24 before extending towards and underneath chair leg 164. Preferably, the portion 162 of the foot rest 150 does not contact the floor or ground supporting the chair base 152 when the foot rest 150 is attached to the chair base 152. While the chair base 152 is shown as having only four legs, the foot rest 150 could be used, with little or few modifications, on chair bases having three, five, or even more chair legs, and the portion 162 may extend under one, two, or three of the chair legs, and the extensions 28, 30 may rest on or be supported by more than one chair leg each.

The foregoing description is considered as illustrative only of the principles of the invention. Furthermore, since numerous modifications and changes will readily occur to those skilled in the art, it is not desired to limit the invention to the exact construction and process shown and described above. Accordingly, all suitable modifications and equivalents may be resorted to falling within the scope of the invention as defined by the claims which follow. For example, the cross-sections of the disclosed foot rests may be circular, oval, square, rectangular, or any other shape and the cross-section of any of the disclosed foot rests may be different at different points on the foot rest.

As another example, while most of the disclosed foot rests are substantially u-shaped, square, rectangular, or polygonal, many different shapes are possible so long as the foot rests can be attached to chair rings or chair bases with sufficient stability. Therefore, the extensions 28, 30 are not required to be parallel and they may extend toward or away from each other.

The foot rests of the present invention are also not limited by the number of spokes in chair rings or the number of legs in the chair bases to which the foot rests might be attached. Therefore, foot rests designed in accordance with the present invention may be used with chair rings having any number of spokes and chair bases having any number of legs.

All of the disclosed foot rests may include telescoping or extension capabilities to allow the foot rests to be used with a variety of chair rings and chair bases and to accommodate chair occupants of different sizes and leg lengths. In addition, the disclosed foot rest may be used with stools, seats, or other chairs having rings or leg supports.

The disclosed foot rings may also work with chair rings having different shapes. While the example embodiments where shown for use with circular chair rings, foot rests designed in accordance with the principles of this invention may also be used with chair rings having square, rectangular, triangular, oval, or other shapes. The foot rings will also work with chair rings that are connected to or integral with chair bases or chair legs.

Padding may be used on any of the disclosed foot rests to reduce chatter and noise between the foot rests and the chair rings or chair bases to which the foot rests are attached. In addition, the padding may provide a more secure attachment between the foot rests and the chair rings or chair bases. The padding on the foot rest may also be or include velcro® material which can mate with velcro® material placed on a chair ring or chair base to which the foot rest is attached to more securely attach the foot rest to the chair ring or chair base.

The foot rests of the present invention are not limited by the types of materials from which they are made. Thus, the foot rests may be metallic, wooden, plastic, fiberglass, etc., or a combination of materials. Additionally, the foot rests may be painted or may include cloth, rubber, or plastic coverings to enhance the aesthetic qualities of the foot rest or to provide a protective covering for the foot rests. In addition, some or all of each of the disclosed foot rests may be hollow or solid.

Additions may be made to the foot rests supports of each of the disclosed foot rests to provide further area for a chair occupant to position his or her feet when using the foot rests. For example, plates may be attached to the foot rest support 26 to provide a bigger surface upon which the chair occupant can place his or her feet, thereby reducing the pressure placed on any one area of the chair occupant's feet. The plates may be rotatable about the foot rest support 26 to increase the versatility of the foot rest.

The embodiments of the invention in which an exclusive property or privilege is claimed are defined as follows:

1. An attachment to a chair ring wherein the chair ring is supported by a plurality of spokes that extend radially inward from the ring in angular-spaced relation to each other, said attachment comprising a bar having angled extensions that extend over and rest on the chair ring and hooked ends that engage the spokes of the chair ring.

2. The attachment of claim 1, wherein said bar is substantially u-shaped.

3. An attachment to a chair ring having spokes or a chair base having legs, comprising:

first and second extensions, each of said first and second extensions having a first end and a second end;

a foot rest support connected to said first end of said first extension and said first end of said second extension;

a third extension connected to said second end of said first extension such that an angle exists between said first extension and said third extension;

a fourth extension connected to said second end of said second extension such that said angle exists between said second extension and said fourth extension;

a first hook attached to said third extension; and a second hook attached to said fourth extension.

4. The attachment of claim 3, wherein said first and second extensions are substantially parallel.

5. The attachment of claim 3, wherein said third and fourth extensions are substantially parallel.

6. The attachment of claim 3, wherein said first and second hooks are substantially parallel.

7. The attachment of claim 3, wherein said angle is less 180 degrees.

8. The attachment of claim 3, wherein said angle is between 90 and 135 degrees.

9. The attachment of claim 8, wherein said angle is in a range between 100 and 120 degrees.

10. The attachment of claim 3, wherein said first and third extensions form one continuous piece of material and said second and fourth extensions form one continuous piece of material.

11. The attachment of claim 10, wherein said first, second, third, and fourth extensions and said foot rest support form one continuous piece of material.

12. The attachment of claim 3, wherein said first extension is telescopable and said second extension is telescopable.

13. The attachment of claim 3, wherein said third extension is telescopable and said fourth extension is telescopable.

14. An attachment to a chair base wherein the chair base has at least two legs extending radially from a center support, said attachment comprising a bar forming a substantially U-shaped frame having a foot rest support and two elongated extensions that are spaced-apart in relation to each other, each of which extensions extends over and rests on top of one of the two legs of the chair base and extends to respective hooked ends that engage the respective leg of the chair base on which it rests.

15. An attachment to a chair wherein the chair has a vertical support post, said attachment comprising:

a chair ring having a perimeter section that at least partially surrounds the post at a fixed radial distance from the post;

at least one support extending radially outward from said perimeter section at an angle greater than 135 degrees to the perimeter section, said support having a proximal end fixed in rigid, immoveable relation to the perimeter section and extending radially outward to a distal end; and a foot rest connected to the distal end of said support.

16. The attachment of claim 15, wherein said angle is 180 degrees.

17. The attachment of claim 15, wherein said angle is in a range between 135 and 180 degrees.

18. The attachment of claim 15, wherein said perimeter section is substantially circular.

19. The attachment of claim 15, wherein said perimeter section is polygonal.

20. The attachment of claim 15, wherein said support has an adjustable length.

21. The attachment of claim 15, wherein said foot rest support is t-shaped.

22. An attachment to a chair base wherein the chair base has a plurality of legs extending radially outward from a vertical support post, said attachment comprising a continuous bar in the shape of a closed loop having two spaced-apart extensions, which form opposite sides of the loop and that, when mounted on the chair base, are positioned radially outward from opposite sides of the post and extend over and rest on at least two legs of the chair base, and said loop further having a portion that extends under and contacts a third leg of the chair base.

23. The attachment of claim 22, wherein said bar is substantially rectangularly shaped.

24. Foot rest apparatus for a chair that has a ring supported by a plurality of spokes extending radially from a vertical post, said foot rest apparatus comprising:

a substantially U-shaped frame with an elongated foot rest support and a pair of elongated extensions extending from the elongated foot rest support in spaced apart relation to each other, each of said extensions being long enough to extend over and rest on a portion of the ring and to extend under and contact a spoke when the foot rest support is positioned radially outward from the ring.

25. The foot rest apparatus of claim 24, wherein each of said extensions has an angled portion in which part of the extension is at an angle less than 180° to another part of the extension such that vertical position of the foot rest support in relation to the chair is a function of the angled portion when the elongated extension rests on the ring and is under and in contact with the spoke.

26. The foot rest apparatus of claim 25, wherein said angled portion of the extension is positioned over and rests on the ring.

27. The foot rest apparatus of claim 24, wherein each of said extensions has a hooked end where the extension extends under and contacts the spoke.

28. Foot rest apparatus for a chair that has a vertical post and components that are positioned radially outward from the post in different directions from the post, but which are attached in rigid, substantially immoveable relation to said post, said foot rest apparatus comprising:

a substantially U-shaped frame with an elongated foot rest support and a pair of elongated extensions extending from the elongated foot rest support in spaced-apart relation to each other, each of said extensions being long enough to extend over and rest on one of the components that is positioned radially outward in one direction from the post and to extend under and contact one of the components that is positioned radially outward in another direction from the post when the foot rest support is positioned radially outward from the post.

29. The foot rest apparatus of claim 28, wherein each of said extensions has an angled portion in which part of the extension is at an angle less than 180° from another part of the extension such that vertical position of the foot rest support in relation to the chair is a function of the angled portion.

30. The foot rest apparatus of claim 29, wherein said angled portion of the extension is positioned over and rests on one of the components.

31. The foot rest apparatus of claim 28, wherein each of said extensions has a hooked end where the extension extends under and contacts one of the components.

32. Foot rest apparatus for a chair that has a vertical post and components that are positioned radially outward from the post in different directions from the post, but which are attached in rigid, substantially immoveable relation to said post, said foot rest apparatus comprising:

a substantially U-shaped frame with an elongated foot rest support and a pair of elongated extensions extending from the foot rest support in spaced-apart relation to each other, each of said extensions being long enough to extend over and rest on one portion of one of said components and to extend under and contact another portion of said one of said components when the foot rest support is positioned radially outward from said component.

33. The foot rest apparatus of claim 32, wherein each of said extensions has a terminal end and a hooked portion adjacent said terminal end that extends downwardly and inwardly toward the other extension.

* * * * *